US006935288B2

(12) United States Patent
Ha et al.

(10) Patent No.: US 6,935,288 B2
(45) Date of Patent: Aug. 30, 2005

(54) VARIABLE VALVE LIFT MECHANISM FOR AN ENGINE

(75) Inventors: Kyoung-Pyo Ha, Gyeonggi-do (KR); Chan-Soo Seo, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/749,223

(22) Filed: Dec. 30, 2003

(65) Prior Publication Data

US 2005/0072390 A1 Apr. 7, 2005

(30) Foreign Application Priority Data

Oct. 7, 2003 (KR) ..... 10-2003-0069567

(51) Int. Cl.[7] ..... F01L 1/34

(52) U.S. Cl. ..... 123/90.16; 123/90.15; 123/90.39

(58) Field of Search ..... 123/90.16, 90.15, 123/90.39, 90.44

(56) References Cited

U.S. PATENT DOCUMENTS 5,809,951 A * 9/1998 Kim ..... 123/90.16
6,477,998 B1 11/2002 Nguyen
2004/0069259 A1 * 4/2004 Shui et al. ..... 123/90.16

* cited by examiner

*Primary Examiner*—Thomas Denion
*Assistant Examiner*—Zelalem Eshete
(74) *Attorney, Agent, or Firm*—Morgan Lewis & Bockius LLP

(57) ABSTRACT

A variable valve lift mechanism for an engine, wherein the valve lift can be varied in real time and in a simple construction in response to the operating state of the engine, thereby enabling maximum engine efficiency and improving the output and fuel consumption rate of the engine.

5 Claims, 3 Drawing Sheets

VARIABLE VALVE LIFT MECHANISM FOR AN ENGINE

CROSS-REFERENCE TO RELATED APPLICATIONS

This application claims priority to Korean Patent Application No. 10-2003-0069567, filed on Oct. 7, 2003, which is incorporated fully herein by reference.

FIELD OF THE INVENTION

The present invention relates to a variable valve lift mechanism for an engine and, more particularly, to a technique adapted to vary a rocker arm condition in an engine containing a rocker arm at a valve train to adjust the valve lift.

BACKGROUND OF THE INVENTION

Generally, an adequate valve lift varies according to an operating condition of an engine such that it is necessary to vary a valve lift according to the operating condition in order for the engine to achieve optimal performance for an entire operating region.

SUMMARY OF THE INVENTION

The present invention provides a simple structure for creating an enabling mechanism to vary a rocker arm's movement in the engine when applying a valve train that uses a rocker arm, whereby the valve lift can be adequately varied in response to an operating condition of the engine.

In accordance with a preferred embodiment of the present invention, the variable valve lift mechanism for an engine comprises a rocker arm for transmitting the cam movement to a stem end of a valve. A rotating axle movement means moves a rotating axle of the rocker arm on a moving plane, which is a plane perpendicular to the rotating axle of the rocker arm. A restricting means restricts the rocker arm to prohibit the rocker arm from moving along a longitudinal direction of the rocker arm.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENT

The preferred embodiment of the present invention will now be described in detail with reference to the annexed drawings, where the present embodiment is not limiting the scope of the present invention but is given only as an illustrative purpose.

Figure 1:
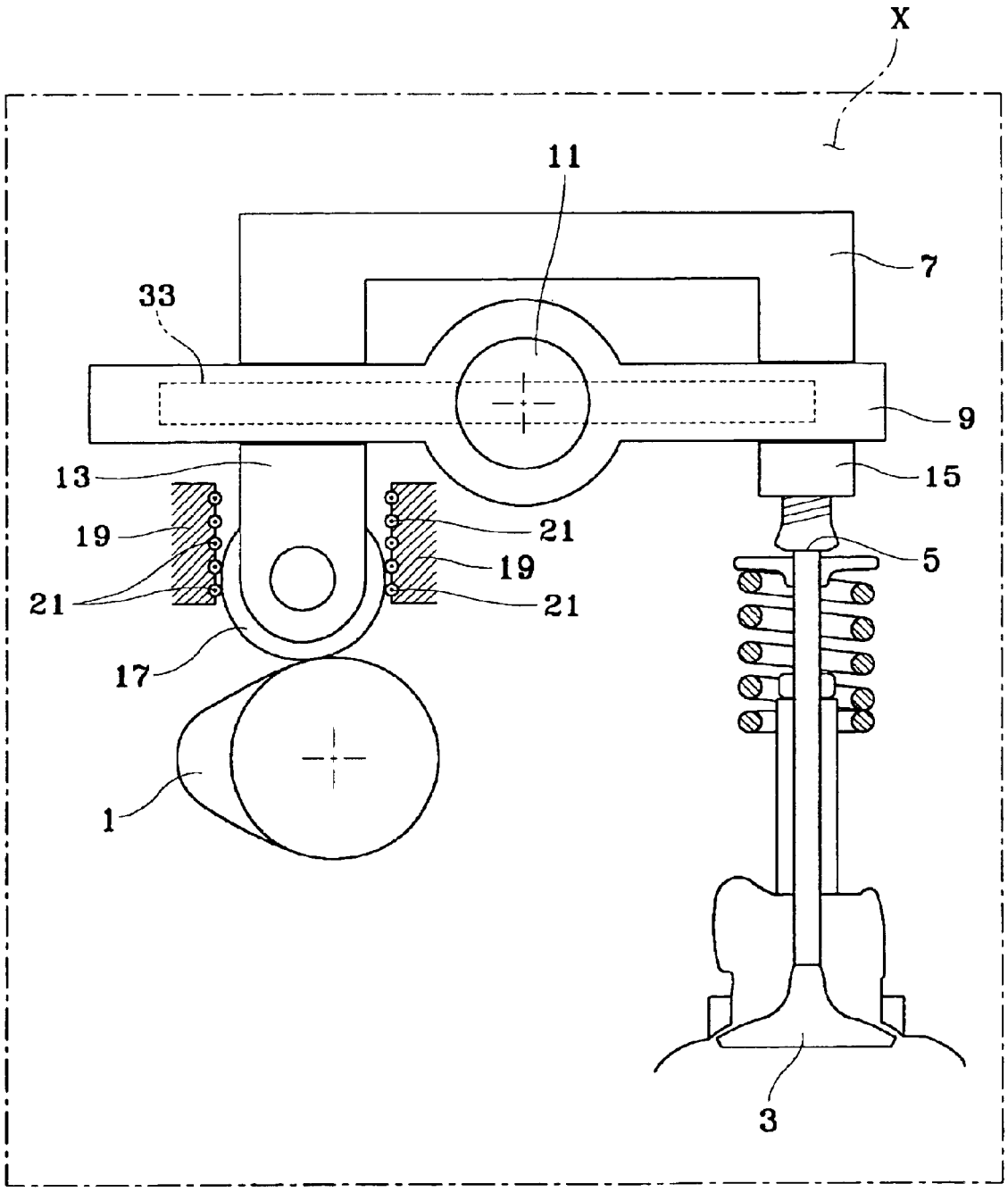
FIG. 1 is a structural drawing of a variable valve lift mechanism for an engine according to an embodiment of the present invention.

Referring to FIG. 1, the variable valve lift mechanism for an engine according to an embodiment of the present invention comprises: a rocker arm 7 for transmitting movement of a cam 1 to a stem end 5 of a valve 3; rotating axle movement means for moving a rotating axle of the rocker arm 7 on a moving plane (X) that is a plane perpendicular to the rotating axle of the rocker arm 7; and restricting means for restricting the rocker arm 7 to prohibit the rocker arm 7 from moving along a longitudinal direction of the rocker arm 7.

The rotating axle movement means in the present embodiment includes a sliding arm 9 supported by the rocker arm 7 so as to linearly slide along a longitudinal direction of the rocker arm 7 on the moving plane, a moveable shaft 11 rotatably supported by the sliding arm 9 to function as a rotating axle of the rocker arm 7, and a sliding means for linearly sliding the moveable shaft 11 along a longitudinal direction of the rocker arm 7.

Both ends of the sliding arm 9 penetrates and are supported by a cam side protruder 13 integrally formed at the rocker arm 7 toward a cam 1 and a valve side protruder 15 integrally formed at the rocker arm 7 toward the valve 3.

The restricting means includes a roller 17 rotatably secured at the cam side protruder 13 to contact the cam 1 and a roller guide 19 to guide the roller 17 to linearly move to a direction perpendicular to a longitudinal direction of the rocker arm 7. The roller guide 19 has a plurality of guide rollers 21 to reduce the friction created when the roller 17 is contacted by the guide rollers 21.

Figure 2:
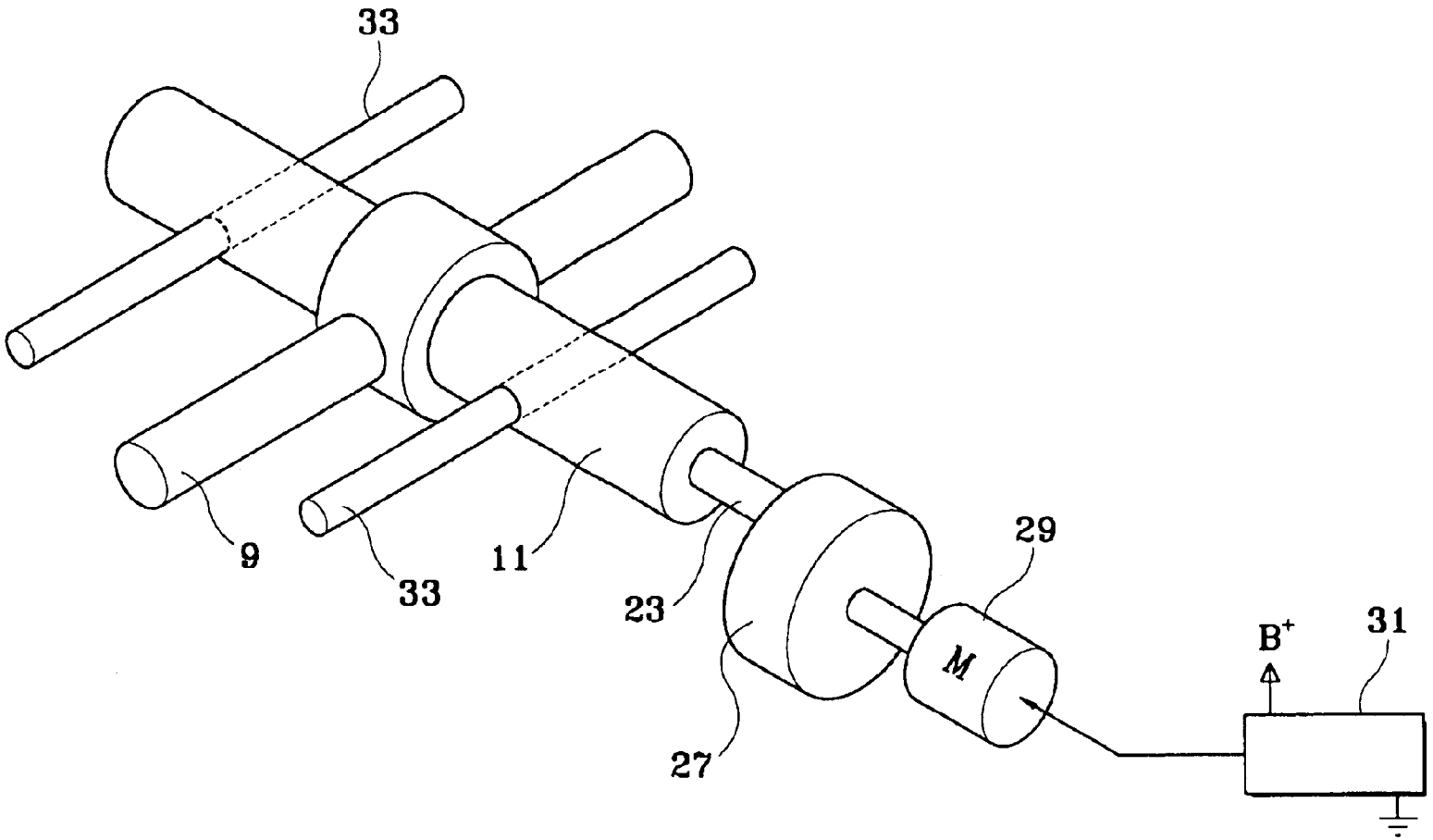
FIG. 2 is a perspective view for illustrating a connecting relationship of the essential parts of FIG. 1.
Figure 3:
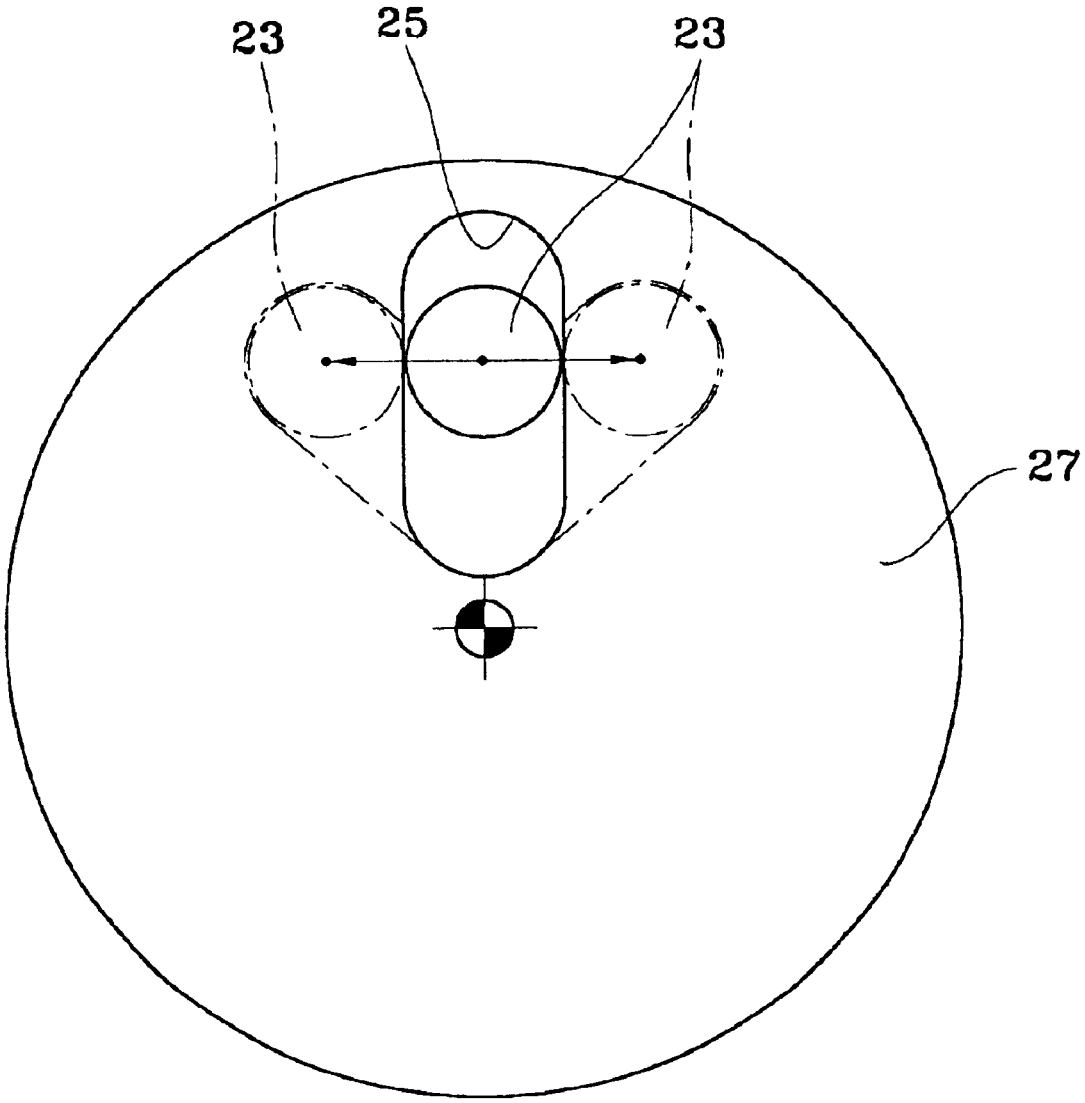
FIG. 3 is a schematic drawing for explaining the operation of a cam plate and a hitching pin.

Referring to FIGS. 2 and 3, the sliding means includes a hitching pin 23 protruding along an axial direction of the moveable shaft 11, a cam plate 27 with an oval hole 25 for the hitching pin 23 to linearly slide therein, a motor 29 for rotating the cam plate 27 so that the hitching pin 23 inserted into the oval hole 25 can linearly move along a longitudinal direction of the rocker arm 7, and a controller for controlling the motor 29 in response to an operating condition of an engine.

Referring again to FIG. 3, the motor 29 is eccentrically formed at a rotating axle thereof relative to the hitching pin 23 on a longitudinal extension line of the oval hole 25, such that, when the cam plate 27 is horizontally rotated, the hitching pin 23 slides into the oval hole 25 to horizontally and linearly move as shown by the dotted line in FIG. 3.

The controller is preferably an engine electronic control unit (ECU 31) for controlling the operating condition of the engine. The moveable shaft 11 is disposed with a guide shaft 33, the guide shaft 33 being parallel with the sliding arm 9 for guiding the movement of the moveable shaft 11 and passing through the moveable shaft 11 as shown in FIG. 2. The guide shaft 33 is of course secured to a cylinder head.

Next, the operation of the present invention thus constructed will be described.

The moveable shaft 11 is positioned leaning toward the left in FIG. 1 when the engine is running at a slow speed.

The distance or a length covered by the rocker arm 7 when lifted by the rotating cam 1 is varied according to a ratio, which is then transmitted to the valve 3, where the ratio is calculated based on a linear distance from a contact point between the cam 1 and the rocker arm 7 to the moveable shaft 11 and a linear distance from a contact point between the stem end 5 of the valve and the rocker arm 7 to the moveable shaft 11.

When the moveable shaft 11 is leaning toward the valve 3 side as mentioned above, the ratio becomes smaller to make the valve lift relatively short.

Under the state thus described above, the more the moveable shaft 11 is moved to the right (i.e., toward the roller), the larger the ratio becomes, and the valve lift grows gradually larger, even though the distance of the rocker arm 7 lifted by the cam 1 is constant. As a result, the engine ECU 31 can simply embody a valve lift by way of the rotation of the motor 29 in response to the running state of the engine.

In other words, when the engine ECU 31 drives the motor 29, the cam plate 27 is rotated to move the hitching pin 23 as depicted in FIG. 3. When the hitching pin 23 is moved, the moveable shaft 11 is supported by the guide shaft 33 to move along the longitudinal direction of the rocker arm 7. As a result, the rotating axle of the rocker arm 7 moves between the cam 1 and the valve 3 to adjust the distance of the rocker arm 7 lifted by the cam 1 at an appropriate ratio, which is then supplied to the valve 3 to prompt the valve lift to be varied.

As apparent from the foregoing, there is an advantage in the variable valve lift mechanism for an engine thus described according to an embodiment of the present invention in that a valve lift can be varied in real time, and in a simple construction, in response to an operating state of the engine, thereby enabling maximum engine efficiency and improving the output and fuel consumption rate of the engine.

The foregoing description of the preferred embodiment of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto and their equivalents.

What is claimed is:

1. A variable valve lift mechanism for an engine, comprising:

a rocker arm for transmitting a cam movement to a stem end of a valve;

a rotating axle movement means for moving a rotating axle of said rocker arm on a moving plane which is a plane perpendicular to said rotating axle of said rocker arm; and a restricting means for restricting said rocker arm to prohibit the rocker arm from moving along a longitudinal direction of said rocker, wherein said rotating axle movement means comprises;

a sliding arm supported by said rocker arm so as to linearly slide on said moving plane along said longitudinal direction of said rocker arm;

a moveable shaft rotatably supported by said sliding arm to function as a rotating axle of said rocker arm; and a sliding means for linearly sliding said moveable shaft along said longitudinal direction of said rocker arm and, wherein said sliding arm comprises:

a cam side protruder integrally formed at said rocker arm toward said cam; and a valve side protruder integrally formed at said rocker arm toward said valve.

2. The mechanism as defined in claim 1, wherein said restricting means comprises:

a roller rotatably secured at said cam side protruder to contact said cam; and a roller guide for guiding said roller to linearly move to a direction perpendicular to said longitudinal direction of said rocker arm.

3. The mechanism as defined in claim 2, wherein said roller guide has a plurality of guide rollers for reducing friction created by said roller when said roller is contacted by said guide rollers.

4. The mechanism as defined in claim 1, wherein said sliding means comprises:

a hitching pin protruding along an axial direction of said moveable shaft;

a cam plate with an oval hole for said hitching pin to linearly slide therein;

a motor for rotating said cam plate so that said hitching pin inserted into the oval hole can linearly move along said longitudinal direction of said rocker arm; and a controller for controlling said motor in response to an operating condition of an engine.

5. The mechanism as defined in claim 1, wherein said movable shaft further comprises a guide shaft that is disposed within said movable shaft and mounted parallel with said sliding arm to guide any movement of said moveable shaft.

* * * * *